US008925554B2

(12) United States Patent
Hackman et al.

(10) Patent No.: US 8,925,554 B2
(45) Date of Patent: Jan. 6, 2015

(54) COMFORTABLE MOUTH GUARD

(76) Inventors: John A. Hackman, Kimberton, PA (US); Bobbie Quinn, Kimberton, PA (US); Travis Armideo, Kimberton, PA (US)

( * ) Notice: Subject to any disclaimer, the term of this patent is extended or adjusted under 35 U.S.C. 154(b) by 0 days.

(21) Appl. No.: 13/500,246

(22) PCT Filed: Jun. 17, 2010

(86) PCT No.: PCT/US2010/038926

§ 371 (c)(1), (2), (4) Date: Apr. 4, 2012

(87) PCT Pub. No.: WO2011/159299

PCT Pub. Date: Dec. 22, 2011

(65) Prior Publication Data

US 2012/0199141 A1 Aug. 9, 2012

(51) Int. Cl.
*A61C 5/14* (2006.01)
*A63B 71/08* (2006.01)

(52) U.S. Cl.
CPC ..... *A63B 71/085* (2013.01)
USPC ..... 128/861; 128/859

(58) Field of Classification Search
USPC ..... 128/859, 861, 862; 433/6
See application file for complete search history.

(56) References Cited

U.S. PATENT DOCUMENTS

| | | | | |
|---|---|---|---|---|
| 3,943,924 | A | 3/1976 | Kallestad et al. | |
| 5,031,638 | A * | 7/1991 | Castaldi | 128/861 |
| 5,636,379 | A * | 6/1997 | Williams | 2/455 |
| 6,092,524 | A | 7/2000 | Barnes | |
| 2004/0154625 | A1 | 8/2004 | Foley | |
| 2007/0084471 | A1 | 4/2007 | Napoli et al. | |

* cited by examiner

*Primary Examiner* — Patricia Bianco
*Assistant Examiner* — Keri J Nelson
(74) *Attorney, Agent, or Firm* — Cheryl R. Figlin, Esq.; Feigin & Associates, LLC.

(57) ABSTRACT

A comfortable mouth guard for upper teeth of a wearer which does not interfere with ability to speak or breath is described wherein at least 70% of the lingual side of the anterior teeth are uncovered. In some embodiments soft inserts increase the thickness of the posterior portions, and in some embodiments a hard insert provides increased protection of the anterior teeth. The hard insert can be used in mouth guards whether or not they include the comfort feature.

14 Claims, 6 Drawing Sheets

COMFORTABLE MOUTH GUARD

PRIORITY CLAIM

This is a U.S. national stage of application No. PCT/US2010/038926, filed on Jun. 17, 2010.

BACKGROUND OF THE INVENTION

The present invention relates to the field of mouth guards, especially mouth guards suited for athletic and other activities where protection of teeth is important.

Conventional mouth guards are designed to fully cover a wearer's teeth with as much thickness as can be tolerated by the wearer. Some types of conventional mouth guards are designed to be worn on the upper teeth and to redistribute the impact associated with blows to the jaw, mouth, or chin. Such mouth guards are substantially U-shaped and are molded from a moldable plastic precursor, either by molding the precursor to an impression or by softening the precursor by preheating it and allowing the wearer to bite into the precursor to configure the mouth guard to the upper teeth. Such mouth guards include a channel defined by an interior side wall, an exterior side wall, and a bottom wall.

Such conventional mouth guards are often uncomfortable and often interfere with speech of the wearer, thereby causing some wearers to remove the mouth guard often during use, for example at an athletic event.

It is an object of the present invention to provide an improved, more comfortable mouth guard wherein the wearer's teeth are adequately protected but where interference with speech and breathing are minimized.

Others have attempted to meet this objective but have failed in one way or another. For example, U.S. Pat. No. 6,092,524 to Brown, Sr., discloses a mouth guard which includes a front, or labial, wall having a bottom edge spaced a predetermined distance from the lower, or incisal edge of the anterior teeth whereby the lower, or incisal edge is free to engage a wearer's tongue during speech.

The permanent teeth of most humans consist of 16 upper teeth in the upper jaw and 16 lower teeth in the lower jaw. In the Universal Numbering System as illustrated in FIG. 8, the upper teeth are numbered from 1 to 16 starting on the right side and the lower teeth are numbered 17 to 32 starting on the left side. The right and left central incisors are numbered 8 and 9, and the right and left lateral incisors are numbered 7 and 10. The bicuspids are numbered 6 and 11. The upper right set of posterior teeth, called $1^{st}$ and $2^{nd}$ bicuspids, and $1^{st}$, $2^{nd}$ and $3^{rd}$ molars, is numbered 1 to 5 and the upper left set of posterior teeth is numbered 12 to 16. The central and lateral incisors and cuspids are considered the anterior teeth. The anterior teeth each have an incisal edge, a labial side, and a lingual side, a labial gum line, and a lingual gum line. The posterior teeth each have a crown portion which terminates at a gum line.

Mouth guards are conventionally formed by first obtaining an impression of the prospective wearer's dentition, i.e., a negative, and then making a cast or positive model of the dentition from the impression. Then a sheet of plastic such as ethylene vinyl acetate (EVA) is heated to soften it and is placed on the dentition of the model, after which a cylinder is applied over the plastic and compressed air is blown onto the plastic to "press" it and cool it. The resulting molded plastic is known as the first press, and this process is usually repeated with at least one subsequent sheet being pressed, the second sheet being known as the second press. The second press fuses with the first press and does not separate on cooling.

SUMMARY OF THE INVENTION

The mouth guard of the invention is configured to fit on and protect the upper teeth of a wearer and comprises a left posterior portion and a right posterior portion, the left and right posterior portions molded to conform to and surround the left set and right set of posterior teeth, respectively, and a central portion shaped to overlay the anterior teeth. It has been discovered that it is crucial to wrap the bottom of the mouth guard around the incisal edge of the upper central and lateral incisors in order to protect that edge as well as to maintain comfort and hold the mouth guard in place so that the mouth guard covers between about 5% and 30% of the lingual side of the upper central and lateral incisors, leaving at least about 70% to 95% of the length of the upper central and lateral incisors between the incisal edge and the gum line uncovered. The cuspids are also partially exposed between the gum line and the incisal edge, but not necessarily be at least 70% as are the central and lateral incisors.

In some embodiments the covered section of the central and lateral incisors does not exceed 20% if the distance from the incisal edge to the gum line and at least 80% of the distance from the gum line to the incisal edge of the central and lateral incisors is uncovered.

In most cases the upper anterior teeth which are partially uncovered on the lingual side include both central incisors, and preferably also include the lateral incisors and canines. In some cases one or more incisors or canines are missing, in which case the mouth guard can be configured to fill in the gaps where teeth are missing.

The mouth guard of the invention includes a portion which overlaps the incisal edge of the anterior teeth for protection from front impact as well as from impact from lower teeth which is of minimal thickness on the incisal edge. In some embodiments the thickness on the incisal edge is 3 to 8 mm before pressing or molding, and 30 to 50% less after pressing or molding.

The exposure of the uncovered portion of the lingual side of the anterior teeth between the gum line and the mouth guard allows the wearer to speak without interference and also improves the comfort of the mouth guard.

DETAILED DESCRIPTION

Figure 1:
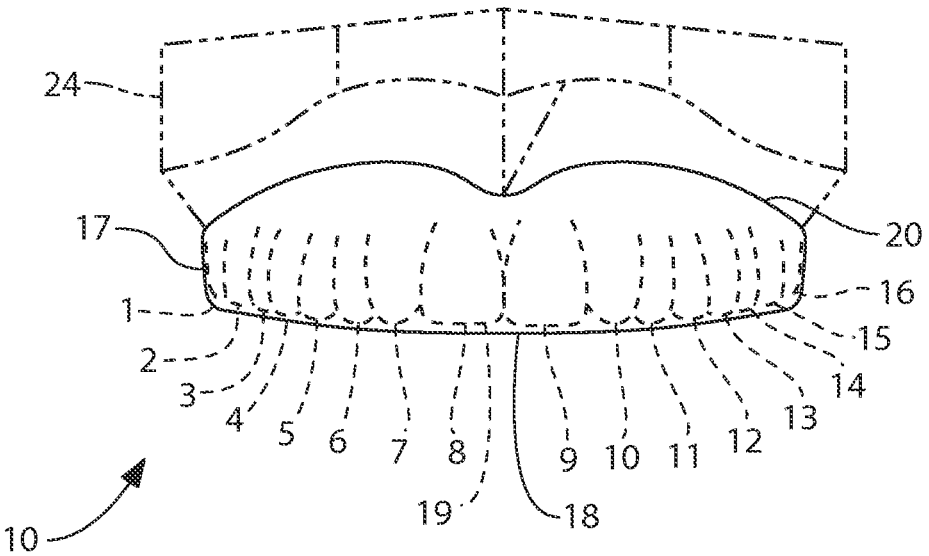
FIG. 1 is a front view of a mouth guard according to the invention showing a model in phantom with the teeth indicated by their Universal Tooth Numbering System numbering.
Figure 8:
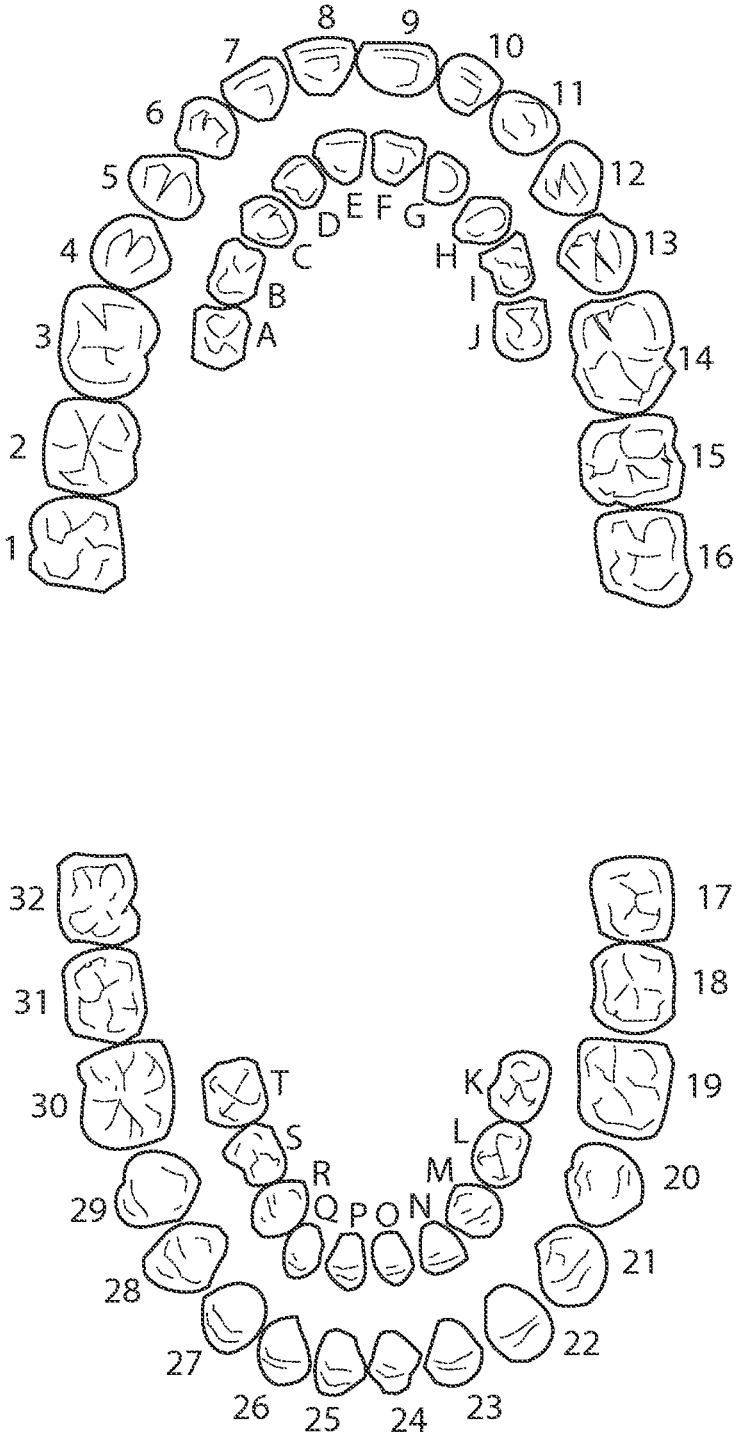
FIG. 8 is a diagram of the Universal tooth numbering system entitled "Diagram of the Tooth Numbering System."

Referring now to the drawings, and, more particularly, to FIG. 1 thereof, a preferred embodiment of the present invention provides an improved mouth guard 17 illustrated on a upper jaw model 24 which includes teeth numbered 1 to 16, following the Universal Teeth Numbering System numbering scheme which is described in FIG. 8. FIG. 1 is a view from the labial, or front, side of the mouth guard 17, showing the teeth and model in phantom. The six anterior teeth, numbers 6 to 11, have incisal edges 19 which are covered by a portion 18 of the mouth guard. The labial sides of all of the teeth are covered by the mouth guard, from the top 20 to the incisal edge 19.

Figure 2:
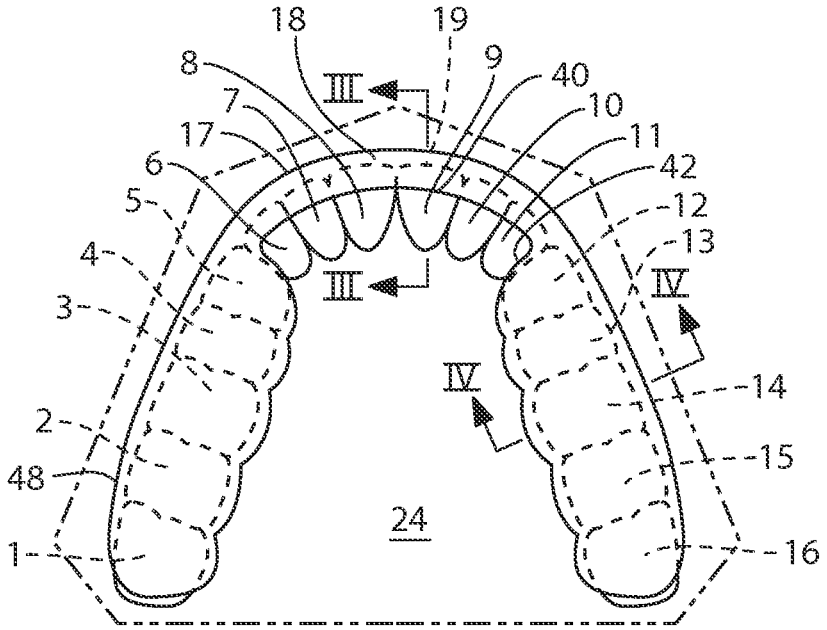
FIG. 2 is an underside view of a mouth guard according to the invention mounted on the model, showing the covered portion of the teeth in phantom.

Referring to FIG. 2 which illustrates an underside view of a mouth guard 17 according to the invention mounted on the model 24, showing the covered portion of the teeth in phantom, posterior teeth, numbers 1-5 and 12-16, are completely covered by the mouth guard 17 in this embodiment. Anterior teeth 6-11 are covered 18 on the labial side and 70% uncovered on the lingual side, from the incisal edge up to cut line 40. Portion 18 covers the incisal edge 19. The posterior section of the lingual side 42 covers the posterior teeth 12-16 and 1-5. The labial side 48 of the posterior teeth is fully covered by the mouthguard.

Figure 3:
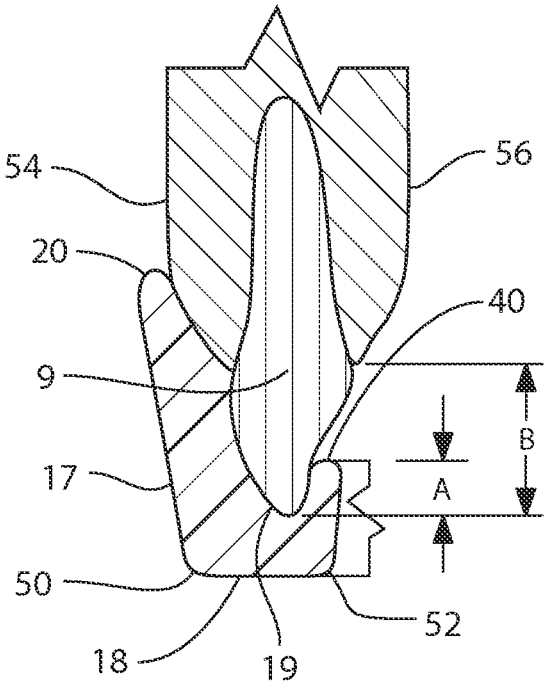
FIG. 3 is a cross-sectional view through III-III of FIG. 2.

FIG. 3 illustrates a cross-sectional view through III-III of FIG. 2, wherein left central incisor 9 having incisal edge 19 is illustrated within the labial side 54 of the gum and lingual side 56 of the gum. The mouth guard 17 has a top 20 labial side, bottom 50 labial side, and bottom lingual side 52 which covers 30%, A, of the distance, B, between the gum line and the incisal edge of tooth 9 as well as teeth 7, 8, and 10 (not shown in FIG. 3). According to the invention, no more than 30% of distance B is covered by portion A, and preferably only 20% is covered. At a minimum, 5% of distance B must be covered. The lingual side of the mouth guard terminates at cut line 40. The incisal edge 19 is covered by a portion 18 of the mouth guard 17.

Figure 4:
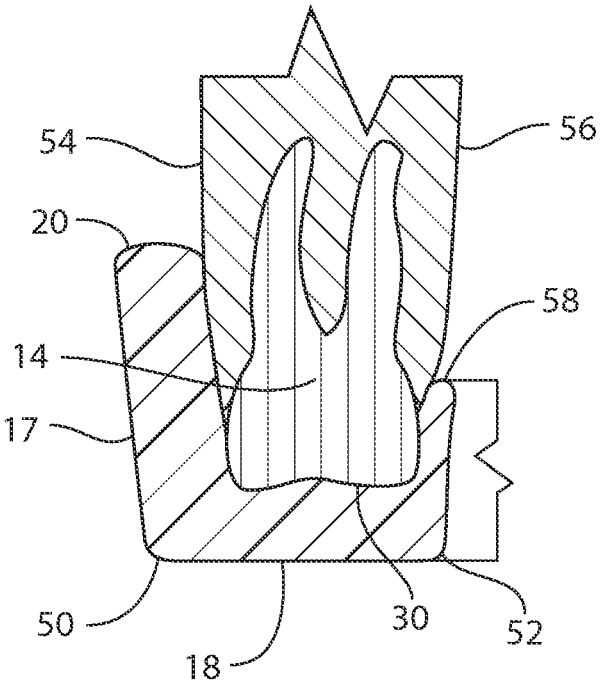
FIG. 4 is a cross-sectional view through IV-IV of FIG. 2.

FIG. 4 illustrates a cross-sectional view through IV-IV of FIG. 2 showing left $1^{st}$ molar 14 covered by mouth guard 17 with the labial side from top 20 to bottom 50 covering a portion of the labial side 54 of the gum and the entire lingual side 58 of the tooth and part of the lingual side 56 of the gum from the bottom 52 of the lingual side of the mouth guard 17 to the gum line 58. The occlusal surface 30 of tooth 14 is also fully covered 18 by mouth guard 17.

Figure 5:
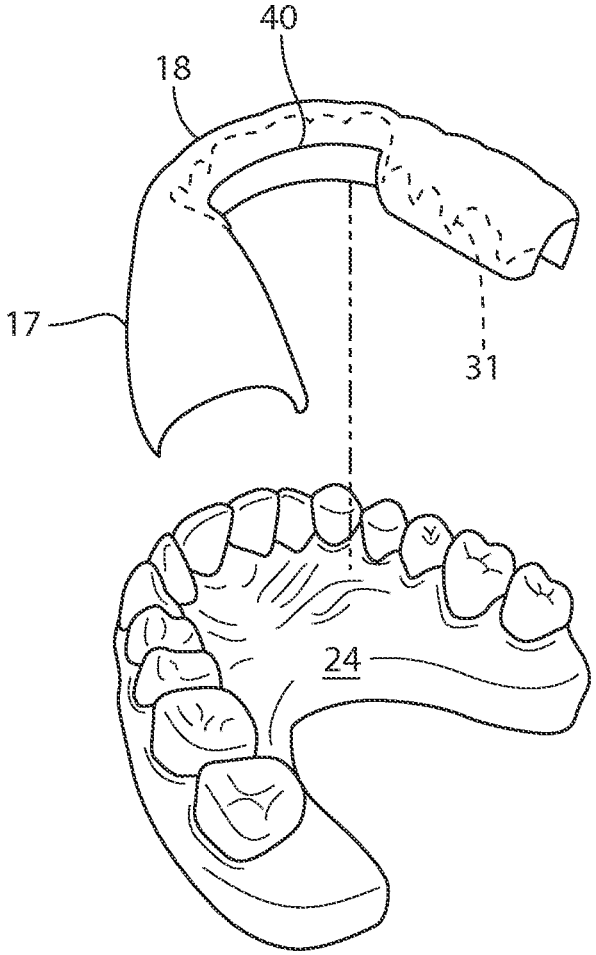
FIG. 5 is a perspective view of a mouth guard of the invention exploded from the model.

FIG. 5 is a perspective view of a mouth guard 17 of the invention exploded from the model 24, with portion 18 covering the incisal edge of the incisors terminating at a line 40 which is 30% of the distance between the incisal edge and the gum line. This embodiment was constructed by placing a molten sheet of EVA on the model 24 of a wearer's teeth and gums, applying compressed air to press and cool the molten sheet of EVA, cutting and trimming the pressed and cooled first sheet, illustrated as having fingers 31 (in phantom), placing a second molten sheet of EVA on the pressed and cooled first sheet, applying compressed air to the second sheet to press and cool the second sheet, and cutting and trimming the second sheet into the illustrated embodiment.

Figure 6:
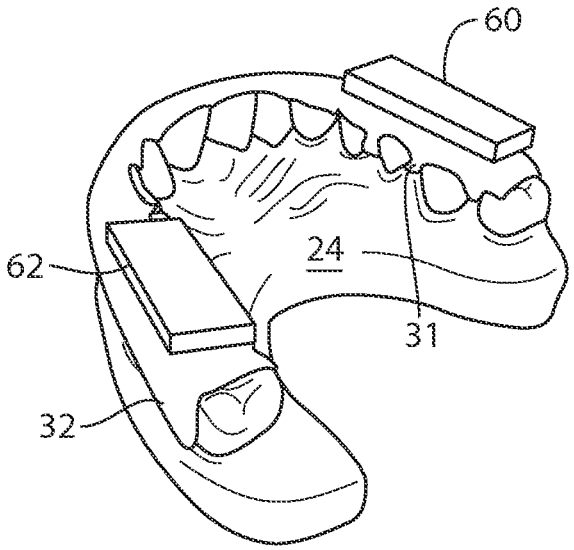
FIG. 6 is a perspective view of a first press of a mouth guard with soft inserts placed on the posterior portions of the first press.

FIG. 6 is a perspective view of a first press 32 illustrating the fingers 31 which are located between the posterior teeth of the model 24. In the embodiment illustrated in this drawing, soft inserts 62 and 60 are placed on the posterior portions of the first press 32. These soft inserts can be EVA and are placed before placing a molten second sheet of EVA over the entire mouth guard.

Figure 7:
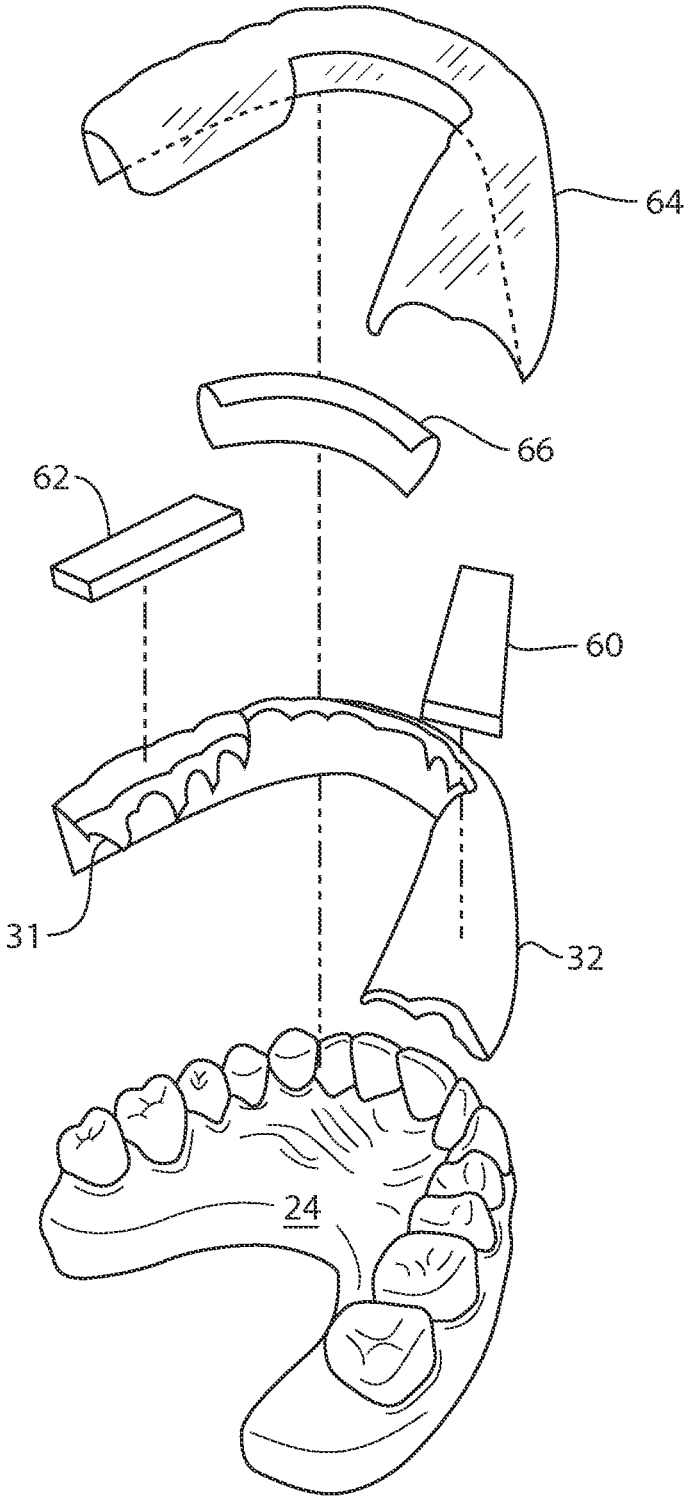
FIG. 7 is a perspective view of the components of an embodiment of a mouth guard according to the invention being exploded from a model.

FIG. 7 is a perspective view of the components of an embodiment of a mouth guard according to the invention being exploded from a model 24 to illustrate how this particular embodiment is constructed. First EVA sheet 24, also known as the "first press, is placed on the model in molten state and is then pressed and cooled with compressed air, and then soft EVA inserts 62 and 60 are placed on the first sheet after it is pressed and cooled. Fingers 31 are formed on this first press. In this embodiment, hard insert 66, which is a co-polyester material having a higher Tg than EVA approved for dental use and sold under the trademark Essix Ace plastic by Raintree Essix, Inc. 4001 Division St, Metairie, La. 70002, is placed on the anterior portion of the first press 32 and then the second sheet 64, also known as the "second press," is heated and placed on top of the hard insert 66, soft inserts 62 and 60, and first sheet 32. Other higher Tg plastics than Essix Ace brand can be used in other embodiments.

The resultant mouth guard has greater thickness above the posterior portions and has greater impact resistance for the anterior teeth than prior mouth guards, while at the same time providing improved comfort, improved protection, and less interference with speaking and breathing than prior mouth guards.

In some embodiments, the hard insert 66 can be used in conventional mouth guards which do not include the comfort feature of the invention.

FIG. 8 is a diagram of the Universal tooth numbering system entitled "Diagram of the Tooth Numbering System." This numbering system is widely used and does not form part of the invention.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The invention is capable of considerable modification, alteration and equivalents in form and function, as will occur to those ordinarily skilled in the pertinent arts. The depicted and described preferred embodiments of the invention are exemplary only and are not exhaustive of the scope of the invention. Consequently, the invention is intended to be limited only by the spirit and scope of the appended claims, giving full cognizance to equivalents in all respects.

What is claimed is:

1. A mouth guard to fit on the upper teeth of a wearer, the upper teeth of the wearer, the upper teeth including anterior teeth consisting of left and right central incisors, lateral incisors, and cuspids, and left and right posterior teeth consisting of 1st, and 2nd bicuspids, and 1st, 2nd, and 3rd molars, the anterior teeth each having an incisal edge, a labial side, and a lingual side, a labial gum line and a lingual gum line, the left and right posterior teeth each having a crown portion which terminates at a gum line, the mouth guard comprising a left posterior portion and a right posterior portion, the left and right posterior portions molded to conform to and surround the wearer's left and right posterior teeth, respectively, and a central portion shaped to completely cover, wrap and engage the incisal edge while overlaying the labial side, and a section of the lingual side of the anterior teeth of the wearer, the section of the mouth guard adapted to fit over the lingual side of the central and lateral incisors being configured to cover at least 5% but not exceeding 30% of the distance from the incisal edge to the gum line of the central and lateral incisors, whereby at least 70% of the distance from the gum line to the incisal edge of the at central and lateral incisors is uncovered by the mouth guard, wherein the section of the mouth guard adapted to cover the cuspids is configured to cover at least 5% and not exceeding 50% of the distance from the incisal edge to the gum line of the cuspids, thereby minimizing interference with speech and improving comfort when the mouth guard is worn by a wearer.

2. The mouth guard of claim 1 wherein the section of the mouth guard adapted to fit over the lingual side of the central and lateral incisors does not exceed 20% of the distance from the incisal edge to the gum line wherein at least 80% of the distance from the gum line to the incisal edge is uncovered.

3. The mouth guard of claim 1 formed by sequentially pressing two or more sheets of ethylene vinyl acetate (EVA) on a model of the wearer's teeth and gums, the sheets having an initial thickness of about 1 to 5 mm prior to pressing and a thickness after pressing reduced by about 30-50% from the initial thickness.

4. The mouth guard of claim 3 wherein the sheets of EVA have an initial thickness of about 3 mm.

5. The mouth guard of claim 1 further including a left and right soft EVA inserts between two sheets of EVA, the soft EVA inserts located in the posterior portions, the soft EVA inserts having a thickness of about 1 to 4 mm.

6. The mouth guard of claim 5 wherein the soft EVA inserts have an initial thickness of about 2 mm.

7. The mouth guard of claim 1 further including a hard insert between two sheets of EVA located in the anterior portion, the hard insert having a higher Tg than the sheets of EVA, the hard insert configured to provide enhanced protection of the anterior teeth of the wearer.

8. The mouth guard of claim 7 wherein the hard insert has a thickness of about 1 to 3 mm.

9. The mouth guard of claim 1 wherein a central portion of the mouth guard which covers the incisal edge, while overlaying the labial side, and a section of the lingual side of the anterior teeth is a thickness of between 0.5 mm to 6 mm.

10. The mouth guard of claim 9 wherein the central portion of the mouth guard that covers the incisal edge, while overlaying the labial side, and a section of the lingual side, further has a labial portion thicker for protection of teeth and lingual portion thinner to accommodate speech.

11. A method of preparing a mouth guard according to claim 1 comprising placing a molten sheet of EVA on a model of a wearer's teeth and gums, applying compressed air to press and cool the molten sheet of EVA, cutting and trimming the pressed and cooled first sheet, placing a second molten sheet of EVA on the pressed and cooled first sheet, applying compressed air to the second sheet to press and cool the second sheet, cutting and trimming the second sheet.

12. The method of claim 11 further including placing soft EVA inserts on the posterior portions of the first sheet prior to placing the molten second sheet on the first sheet.

13. The method of claim 11 further including placing a hard insert on the first sheet of EVA prior to placing the molten second sheet of EVA on the first sheet.

14. A mouth guard to fit on the upper teeth of a wearer, the upper teeth of the wearer, the upper teeth including anterior teeth consisting of left and right central incisors, lateral incisors, and cuspids, and left and right posterior teeth consisting of 1st, and 2nd bicuspids, and 1st, 2nd, and 3rd molars, the anterior teeth each having an incisal edge, a labial side, and a lingual side, a labial gum line and a lingual gum line, the left and right posterior teeth each having a crown portion which terminates at a gum line, the mouth guard comprising a left posterior portion and a right posterior portion, the left and right posterior portions molded to conform to and surround the wearer's left and right posterior teeth, respectively, and a central portion shaped to completely cover, wrap and engage the incisal edge while overlaying the labial side, and a section of the lingual side of the anterior teeth of the wearer, the section of the mouth guard adapted to fit over the lingual side of the central and lateral incisors being configured to cover at least 5% but not exceeding 30% of the distance from the incisal edge to the gum line of the central and lateral incisors, whereby at least 70% of the distance from the gum line to the incisal edge of the at central and lateral incisors is uncovered by the mouth guard, wherein the section of the mouth guard adapted to cover the cuspids is configured to cover at least 5% and not exceeding 50% of the distance from the incisal edge to the gum line of the cuspids, thereby minimizing interference with speech and improving comfort when the mouth guard is worn by a wearer, and further wherein the mouth guard is formed by sequentially pressing two or more sheets of ethylene vinyl acetate (EVA) on a model of the wearer's teeth and gums, the sheets having an initial thickness of about 1 to 5 mm prior to pressing and a thickness after pressing reduced by about 30-50% from the initial thickness.

* * * * *